US010255841B2

(12) United States Patent
Kim et al.

(10) Patent No.: US 10,255,841 B2
(45) Date of Patent: Apr. 9, 2019

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Sujin Kim, Ulsan (KR); Jongjae Lee, Hwaseong-si (KR); Yanguk Nam, Hwaseong-si (KR); Dae-sik Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 98 days.

(21) Appl. No.: 15/228,998

(22) Filed: Aug. 4, 2016

(65) Prior Publication Data

US 2017/0148375 A1 May 25, 2017

(30) Foreign Application Priority Data

Nov. 23, 2015 (KR) ..... 10-2015-0164269

(51) Int. Cl.
*G09G 3/20* (2006.01)

(52) U.S. Cl.
CPC ..... *G09G 3/2092* (2013.01); *G09G 3/20* (2013.01); *G09G 2300/0426* (2013.01); *G09G 2330/02* (2013.01); *G09G 2330/028* (2013.01)

(58) Field of Classification Search
CPC .... G09G 3/2092; G09G 3/20; G09G 2330/02; G09G 2330/028
See application file for complete search history.

(56) References Cited

U.S. PATENT DOCUMENTS

2014/0111498 A1* 4/2014 Kim ..... G09G 3/3291 345/212
2015/0002970 A1* 1/2015 Kang ..... H02H 9/045 361/86
2015/0229117 A1* 8/2015 Kim ..... H02H 3/08 345/212
2015/0344295 A1* 12/2015 Cattani ..... B81B 7/008 318/116

(Continued)

FOREIGN PATENT DOCUMENTS

KR 92-5376 U 3/1992
KR 10-2012-0049554 A 5/2012

(Continued)

*Primary Examiner* — Lixi C Simpson
(74) *Attorney, Agent, or Firm* — Lewis Roca Rothgerber Christie LLP

(57) ABSTRACT

A display device includes: a first data driving chip including: a first data driving circuit to generate a first data signal; and a first sensor to sense a first overcurrent flowing in the first data driving circuit based on a first power current flowing in the first data driving circuit to generate a first signal; a second data driving chip including: a second data driving circuit to generate a second data signal; and a second sensor to sense a second overcurrent flowing in the second data driving circuit based on a second power current flowing in the second data driving circuit to generate a second signal; and a power controller to control first and second powers respectively supplied to the first and second data driving chips, and to block at least one of the first and second powers based on at least one of the first and second signals.

18 Claims, 6 Drawing Sheets

(56) References Cited

U.S. PATENT DOCUMENTS

| | | | | |
|---|---|---|---|---|
| 2016/0189599 | A1* | 6/2016 | Lee | H02H 3/087<br>345/211 |
| 2016/0241011 | A1* | 8/2016 | Onishi | H03K 17/0822 |

FOREIGN PATENT DOCUMENTS

| | | | |
|---|---|---|---|
| KR | 10-2014-0051594 | A | 5/2014 |
| KR | 10-1500000 | B1 | 3/2015 |

* cited by examiner

DISPLAY DEVICE AND DRIVING METHOD THEREOF

CROSS-REFERENCE TO RELATED APPLICATIONS

This U.S. non-provisional patent application claims priority to and the benefit of Korean Patent Application No. 10-2015-0164269, under 35 U.S.C. § 119, filed on Nov. 23, 2015 in the Korean Intellectual Property Office (KIPO), the entire content of which is hereby incorporated by reference.

BACKGROUND

One or more aspects of example embodiments of the present disclosure relate to a display device and a driving method thereof.

A general display device includes a plurality of pixel electrodes, a plurality of switching elements respectively connected to the plurality of pixel electrodes, and a plurality of gate lines and data lines.

A display device includes an AC/DC conversion unit for converting AC power that is inputted for generating various kinds of voltages into DC power, and an analog circuit unit for converting the converted DC power into an analog driving voltage. A power regulator adjusts a reference power to a set or predetermined level, and a booster circuit, such as a charge pump, boosts the reference power to generate the analog driving voltage.

The analog driving voltage is applied to a data driver for driving the display device. The data driver generates data voltages by using the analog driving voltage, and outputs the data voltages to the data lines through a plurality of buffer units.

The above information disclosed in this Background section is for enhancement of understanding of the background of the inventive concept, and therefore, it may contain information that does not constitute prior art.

SUMMARY

One or more aspects of example embodiments of the present disclose are directed toward a display device for blocking a driving power of a display panel and a driving method thereof.

One or more aspects of example embodiments of the present disclosure are directed toward a display device for controlling each of powers supplied to a plurality of driving chips.

According to an example embodiment of the inventive concept, a display device includes: a first data driving chip including: a first data driving circuit to generate a first data signal; and a first sensor to sense a first overcurrent flowing in the first data driving circuit based on a first power current flowing in the first data driving circuit to generate a first signal; a second data driving chip including: a second data driving circuit to generate a second data signal; and a second sensor to sense a second overcurrent flowing in the second data driving circuit based on a second power current flowing in the second data driving circuit to generate a second signal; and a power controller to control first and second powers respectively supplied to the first and second data driving chips, and to block at least one of the first and second powers based on at least one of the first and second signals.

In an embodiment, the first power current may be a first current flowing in a first power port of the first data driving circuit; the first power port may be connected to the power controller and may be configured to receive the first power; the second power current may be a second current flowing in a second power port of the second data driving circuit; and the second power port may be connected to the power controller and may be configured to receive the second power.

In an embodiment, the first data driving circuit may include a first sensing resistor to transmit the first power current, one end of the first sensing resistor being connected to a first ground terminal of the first data driving circuit; and the second data driving circuit may include a second sensing resistor to transmit the second power current, one end of the second sensing resistor being connected to a second ground terminal of the second data driving circuit.

In an embodiment, the first sensor may include a first comparator including a first input terminal connected to another end of the first sensing resistor to receive a first sensing voltage, a first reference terminal to receive a reference voltage, and a first output terminal to output a first comparison signal; the second sensor may include a second comparator including a second input terminal connected to another end of the second sensing resistor to receive a second sensing voltage, a second reference terminal to receive the reference voltage, and a second output terminal to output a second comparison signal; the first comparison signal may be generated based on the first sensing voltage and the reference voltage; and the second comparison signal may be generated based on the second sensing voltage and the reference voltage.

In an embodiment, the first sensor may further include a first switch including a first input electrode connected to the first output terminal, a first output electrode connected to the power controller, and a first pull-down electrode to receive a pull-down voltage; and the second sensor may further include a second switch including a second input electrode connected to the second output terminal, a second output electrode connected to the power controller, and a second pull-down electrode to receive the pull-down voltage.

In an embodiment, the first switch may further include a first pull-up resistor, one end of the first pull-up resistor to receive a pull-up voltage, and another end of the first pull-up resistor being connected to the first output electrode; and the second switch may further include a second pull-up resistor, one end of the second pull-up resistor to receive the pull-up voltage, and another end of the second pull-up resistor being connected to the second output electrode.

In an embodiment, the first and second comparison signals may have a high voltage and the first and second switches may be configured to be turned on, when the first and second sensing voltages are greater than the reference voltage; and the first and second comparison signals may have a low voltage and the first and second switches may be configured to be turned off, when the first and second sensing voltages are less than or equal to the reference voltage.

In an embodiment, each of the first and second signals may have the pull-down voltage, when the first and second switches are turned on; and each of the first and second signals may have the pull-up voltage, when the first and second switches are turned off.

In an embodiment, the power controller may be configured to determine which one from among the first and second data driving chips an overcurrent flows based on the first and second signals, and to block each of the first and second powers.

In an embodiment, the power controller may include: a first sub power controller connected to the first sensor, the first sub power controller to block the first power based on the first signal; and a second sub power controller connected to the second sensor, the second sub power controller to block the second power based on the second signal.

In an embodiment, the first data driving circuit may include a first sensing resistor to transmit the first power current, one end of the first sensing resistor being connected to a first power terminal of the first data driving circuit; and the second data driving circuit may include a second sensing resistor to transmit the second power current, one end of the second sensing resistor being connected to a second power terminal of the second data driving circuit.

In an embodiment, the first sensor may include a first comparator including a first input terminal connected to another end of the first sensing resistor to receive a first sensing voltage, a first reference terminal to receive a reference voltage, and a first output terminal to output a first comparison signal; and the second sensor may include a second comparator including a second input terminal connected to another end of the second sensing resistor to receive a second sensing voltage, a second reference terminal to receive the reference voltage, and a second output terminal to output a second comparison signal.

According to an example embodiment of the inventive concept, a display device driving method includes: sensing a first overcurrent flowing in a first data driving circuit based on a first power current flowing in the first data driving circuit for generating a first data signal; generating a first signal based on a result obtained by sensing the first overcurrent flowing in the first data driving circuit; sensing a second overcurrent flowing in a second data driving circuit based on a second power current flowing in the second data driving circuit for generating a second data signal; generating a second signal based on a result obtained by sensing the second overcurrent flowing in the second data driving circuit; and blocking at least one of a first power provided to the first data driving circuit and a second power provided to the second data driving circuit based on at least one of the first and second signals.

In an embodiment, the generating of the first signal may include comparing a reference voltage and a first sensing voltage applied to a first sensing resistor where the first power current flows to generate a first comparison signal.

In an embodiment, the generating of the second signal may include comparing the reference voltage and a second sensing voltage applied to a second sensing resistor where the second power current flows to generate a second comparison signal.

In an embodiment, the generating of the first signal may further include generating a pull-up voltage or a pull-down voltage as the first signal in response to the first comparison signal.

In an embodiment, the generating of the first signal may further include: when the first comparison signal is a high voltage, generating the pull-down voltage as the first signal in response to the high voltage; and when the first comparison signal is a low voltage, generating the pull-up voltage as the first signal in response to the low voltage.

In an embodiment, the first power current may flow in a first power port of the first data driving circuit, and the first power port may be connected to a power controller, the power controller for supplying the first and second powers; and the second power current may flow in a second power port of the second data driving circuit, and the second power port may be connected to the power controller.

In an embodiment, the blocking of the at least one of the first and second powers may include: blocking the first power based on the first signal; and blocking the second power based on the second signal.

In an embodiment, the first data driving circuit may supply the first data signal to a display panel through a data line on the display panel; and the second data driving circuit may supply the second data signal to the display panel through the data line.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept, and together with the description, serve to explain aspects and features of the inventive concept. In the drawings.

DETAILED DESCRIPTION

Figure 1:
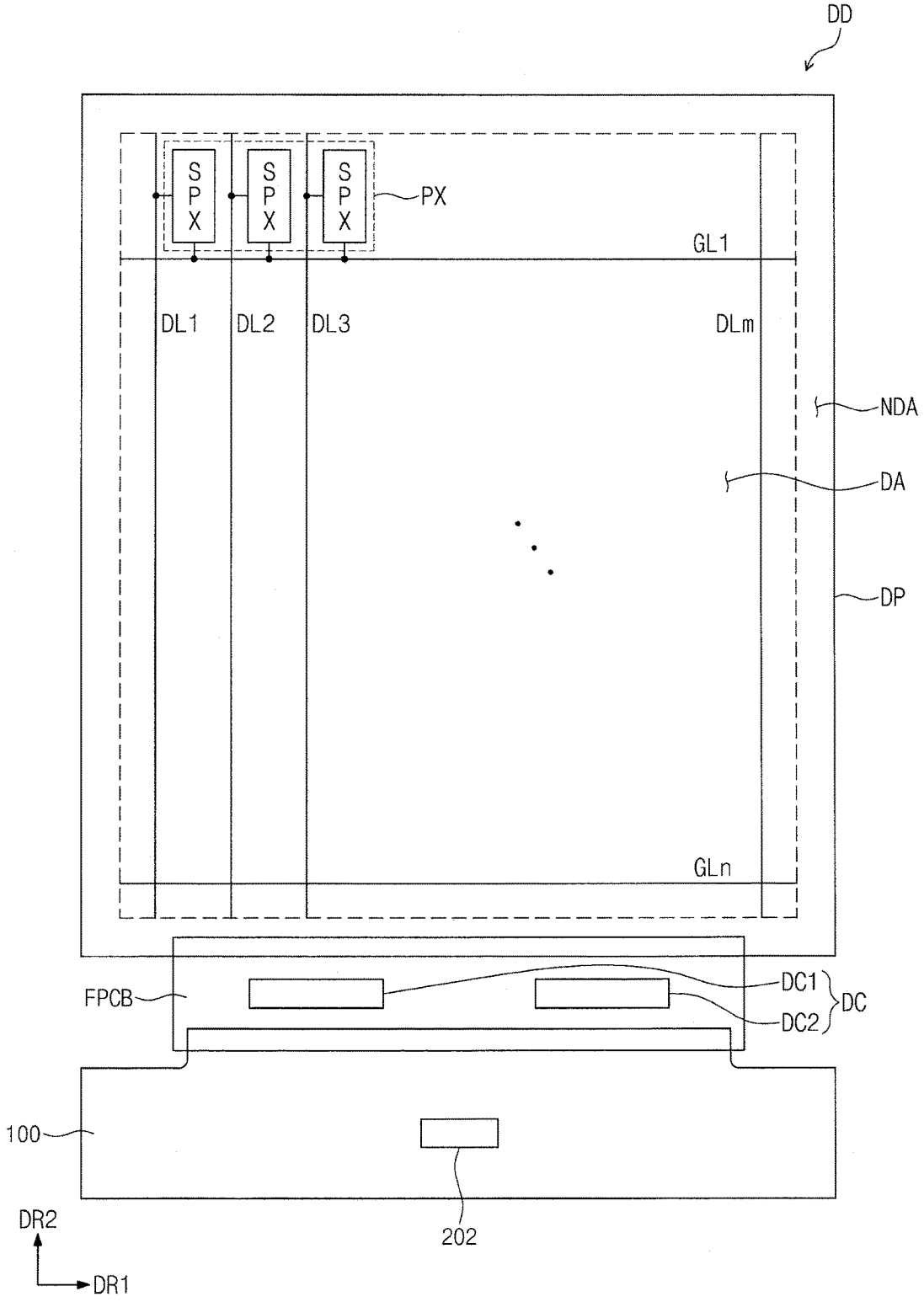
FIG. 1 is a plan view illustrating a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration. Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a plan view illustrating a display device according to an embodiment of the inventive concept.

Referring to FIG. 1, a display device DD according to an embodiment of the inventive concept includes a printed circuit board 100, a flexible printed circuit board FPCB, a plurality of driving chips DC, a power control unit (e.g., a power controller) 202, and a display panel DP.

The display panel DP may display an image through a display area DA. The display area DA may be driven by a control signal and image data supplied from the printed circuit board 100.

The display panel DP may include a plurality of gate lines GL1 to GLn, a plurality of data lines DL1 to DLm, and a plurality of sub pixels SPX, all of which are disposed in the display area DA. The gate lines GL1 to GLn extend in a first direction DR1, and are arranged with each other along a second direction DR2, for example. The data lines DL1 to DLm cross the gate lines GL1 to GLn and are insulated from the gate lines GL1 to GLn. For example, the data lines DL1 to DLm extend in the second direction DR2, and are arranged with each other along the first direction DR1. The display panel DP may further include drive wires provided in a non-display area NDA surrounding the display area DA. The drive wires may deliver signals used for driving the sub pixels SPX. For example, the signals used for driving the sub pixels SPX may include gate signals and data signals.

Each of the sub pixels SPX is connected to a corresponding gate line from among the gate lines GL1 to GLn and to a corresponding data line from among the data lines DL1 to DLm.

The sub pixels SPX may be arranged in a matrix along the first and second directions DR1 and DR2. Each of the sub pixels SPX may display one of primary colors, such as, for example, red, green, and blue. However, the color displayed by the sub pixels SPX is not limited to red, green, and blue, and the sub pixels SPX may display various other colors, for example, secondary primary colors such as white, yellow, cyan, and magenta, in addition to or in lieu of red, green, and blue colors.

The sub pixels SPX may form a pixel PX. According to an embodiment of the inventive concept, three sub pixels SPX may form one pixel PX. However, the inventive concept is not limited thereto, and thus, two, four, or more sub pixels SPX may form one pixel PX.

The pixel PX is a device for displaying a unit image, and the resolution of the display panel DP may be determined according to the number of the pixels PX provided in the display panel DP. For convenience, only one pixel PX is shown in FIG. 1 and the other pixels PX are omitted.

The flexible printed circuit board FPCB may connect the display panel DP and the printed circuit board 100 to each other.

The flexible printed circuit board FPCB may include a plurality of driving chips DC. The plurality of driving chips DC may be mounted on the flexible printed circuit board FPCB through a Tape Carrier Package (TCP). Each of the plurality of driving chips DC may include a chip for implementing a data driver. Additionally, each of the plurality of driving chips DC may include a chip for implementing a gate driver.

According to an embodiment of the inventive concept, the power control unit 202 may be on the printed circuit board 100. However, the inventive concept is not limited thereto, and according to another embodiment of the inventive concept, the power control unit 202 may be mounted on the flexible printed circuit board FPCB.

The power control unit 202 may supply power for driving the data driver and the gate driver.

In more detail, each of the plurality of driving chips DC may receive power from the power control unit 202, and a circuit formed in each of the plurality of driving chips DC may be driven by the power supplied by the power control unit 202.

According to an embodiment of the inventive concept, a circuit for implementing the data driver may be mounted in each of the plurality of driving chips DC, and each of the plurality of driving chips DC may receive power from the power control unit 202 and may serve as the data driver.

A first data driving chip DC1 and a second driving chip DC2 are shown in FIG. 1 as an example of the plurality of driving chips DC. However, the plurality of driving chips DC is not limited to two, and may include three or more.

The first data driving chip DC1 may output first data signals from among the data signals to the sub pixels SPX through the data lines DL1 to DLm to drive the sub pixels SPX. The second data driving chip DC2 may output second data signals from among the data signals to the sub pixels SPX through the data lines DL1 to DLm to drive the sub pixels SPX.

According to an embodiment of the inventive concept, the first and second data driving chips DC1 and DC2 may drive sub pixels that are disposed in different areas.

Figure 2:
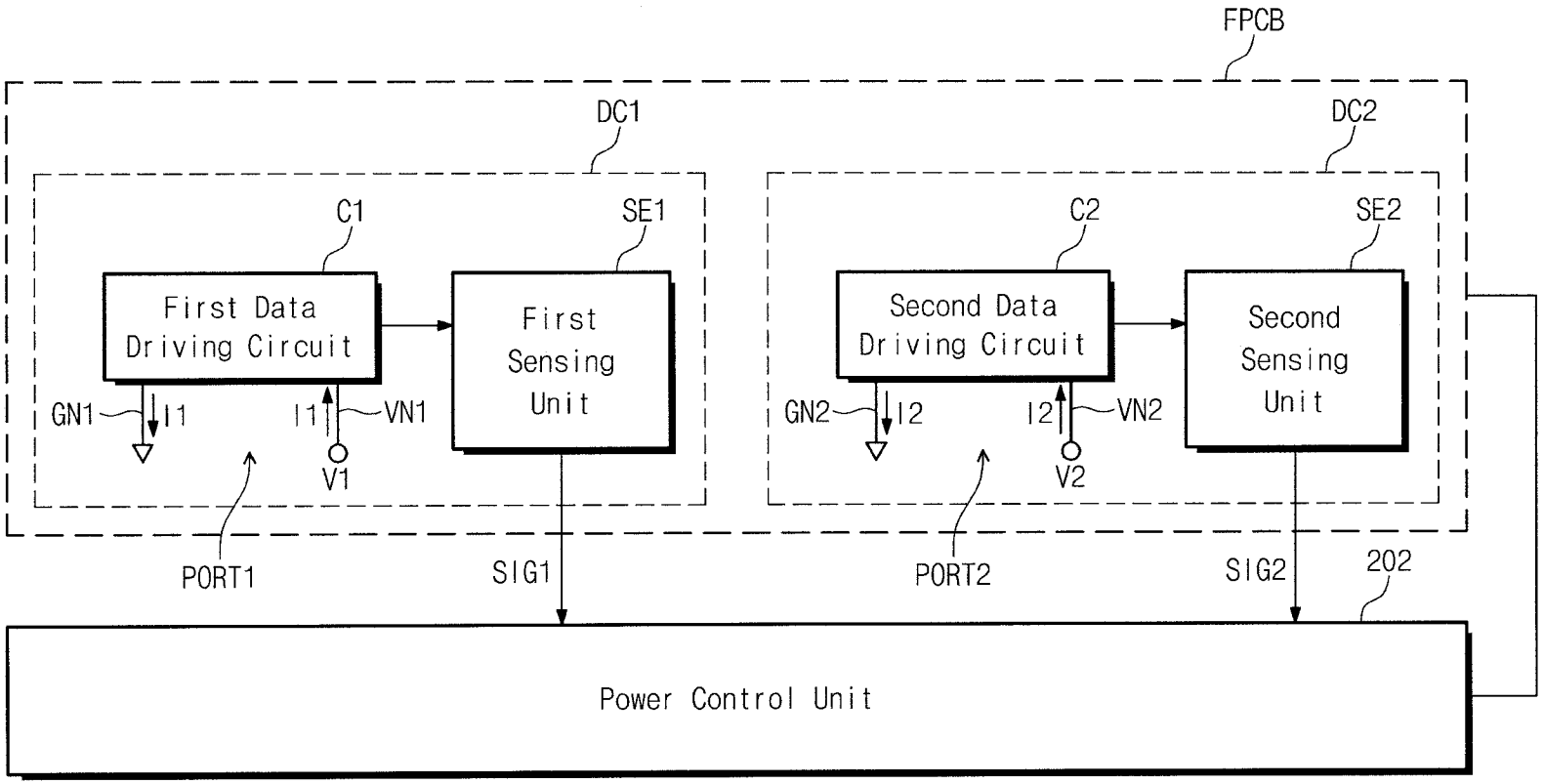
FIG. 2 is a block diagram illustrating a flexible printed circuit board shown in FIG. 1 according to an embodiment of the inventive concept.

FIG. 2 shows that the two driving chips DC1 and DC2 are mounted on the flexible printed circuit board FPCB, but the inventive concept is not limited thereto.

FIG. 2 is a block diagram illustrating the flexible printed circuit board FPCB shown in FIG. 1 according to an embodiment of the inventive concept.

Referring to FIG. 2, a first driving circuit C1 and a first sensing unit (e.g., a first sensor) SE1 may be on the first data driving chip DC1. A second driving circuit C2 and a second sensing unit (e.g., a second sensor) SE2 may be on the second data driving chip DC2. For convenience of description, some components may be omitted in FIG. 2.

For example, the first data driving circuit C1 and the second data driving circuit C2 may be circuits corresponding to the data driver.

The first data driving circuit C1 may include a first power port PORT1. A first power terminal VN1 and a first ground terminal GN1 may be disposed at the first power port PORT1. The first data driving circuit C1 receives a first power V1 from the power control unit 202 through the first power terminal VN1, and a first power current I1 may flow through the first power terminal VN1 and the first ground terminal GN1 according to the first power V1. For example, the first data driving circuit C1 may receive the first power V1. In more detail, the first power current I1 may be a current flowing in the first power port PORT1, and the first power port PORT1 may be connected to the power control unit 202.

The second data driving circuit C2 may include a second power port PORT2. A second power terminal VN2 and a second ground terminal GN2 may be disposed at the second power port PORT2. The second data driving circuit C2 receives a second power V2 from the power control unit 202 through the second power terminal VN2, and a second power current I2 may flow through the second power terminal VN2 and the second ground terminal GN2 according to the second power V2. For example, the second data driving circuit C2 may receive the second power V2. In more detail, the second power current I2 may be a current flowing in the second power port PORT2, and the second power port PORT2 may be connected to the power control unit 202.

The first data driving circuit C1 may be electrically connected to the first sensing unit SE1.

The second data driving circuit C2 may be electrically connected to the second sensing unit SE2.

The first sensing unit SE1 may output a first signal SIG1.

The power control unit 202 may receive the first signal SIG1 to block at least one power selected from the first power V1 and the second power V2.

The second sensing unit SE2 may output a second signal SIG2.

The power control unit 202 may receive the second signal SIG2 to block at least one power selected from the first power V1 and the second power V2.

In summary, the power control unit 202 may receive the first signal SIG1 and/or the second signal SIG2 to block at least one power selected from the first power V1 and the second power V2. Accordingly, the power control unit 202 may block the first power current I1 flowing in the first data driving circuit C1 and/or the second power current I2 flowing in the second data driving circuit C2.

Figure 3:
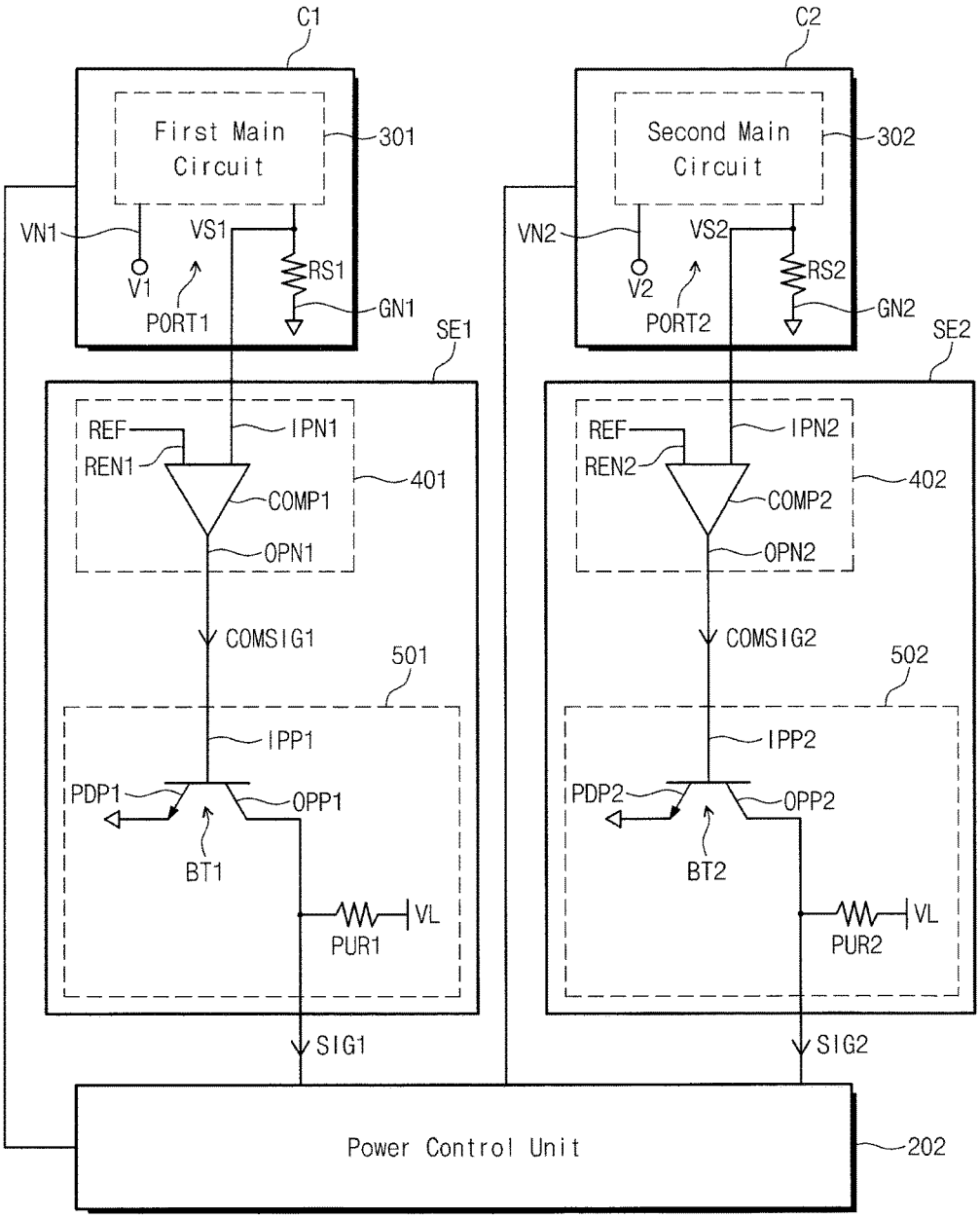
FIG. 3 is a schematic circuit of a first data driving circuit, a first sensing unit, a second data driving circuit, and a second sensing unit shown in FIG. 2 according to an embodiment of the inventive concept.

FIG. 3 is a schematic circuit of a first data driving circuit, a first sensing unit (e.g., a first sensor), a second data driving circuit, and a second sensing unit (e.g., a second sensor) shown in FIG. 2.

Referring to FIGS. 2 and 3, the first data driving circuit C1 may include a first main circuit 301, a first power port PORT1, and a first sensing resistor RS1.

The first main circuit 301 may be a circuit for implementing data driver function. The first main circuit 301 may be implemented with a combination of various passive elements, active elements, and circuits connecting them without being limited to a specific circuit. For example, the first main circuit 301 may be realized with a circuit where the Thevenin voltage and the Thevenin resistor are connected in series.

One end of the first sensing resistor RS1 may be connected to the first ground terminal GN1. The first power current I1 may flow in the first sensing resistor RS1.

The first power current I1 may be a part of a current flowing in the first main circuit 301.

The second data driving circuit C2 may include a second main circuit 302, a second power port PORT2, and a second sensing resistor RS2.

The second main circuit 302 may be a circuit for implementing data driver function. The second main circuit 302 may be implemented with a combination of various passive elements, active elements, and circuits connecting them without being limited to a specific circuit. For example, the second main circuit 302 may be realized with a circuit where the Thevenin voltage and the Thevenin resistor are connected in series.

One end of the second sensing resistor RS2 may be connected to the second ground terminal GN2. The second power current I2 may flow in the second sensing resistor RS2.

The second power current I2 may be a part of a current flowing in the second main circuit 302.

The first sensing unit SE1 may include a first comparison unit (e.g., a first comparator) 401 and a first switching unit (e.g., a first switch) 501.

The first comparison unit 401 may include a first input terminal IPN1, a first reference terminal REN1, and a first output terminal OPN1. A reference voltage (e.g., a predetermined reference voltage) REF may be applied to the first reference terminal REN1. A voltage may be applied to the first input terminal IPN1 to be compared with the reference voltage REF.

In more detail, the voltage applied to the first input terminal IPN1 may be compared with the reference voltage REF by the first comparison unit 401. The first comparison unit 401 may output a first comparison signal COMSIG1 having a high or a low voltage through the first output terminal OPN1 by comparing the voltage applied to the first input terminal IPN1 with the reference voltage REF.

For example, the first input terminal IPN1 may be connected to another end of the first sensing resistor RS1. As the one end of the first sensing resistor RS1 is connected to the first ground terminal GN1 and the other end of the first sensing resistor RS1 is connected to the first input terminal IPN1, a first sensing voltage VS1 may be applied to the first input terminal IPN1.

The first comparison unit 401 may compare the first sensing voltage VS1 with the reference voltage REF, and may output the first comparison signal COMSIG1 through the first output terminal OPN1 corresponding to the comparison.

The second sensing unit SE2 may include a second comparison unit 402 and a second switching unit 502.

The second comparison unit 402 may include a second input terminal IPN2, a second reference terminal REN2, and a second output terminal OPN2. The reference voltage REF may be applied to the second reference terminal REN2. A voltage may be applied to the second input terminal IPN2 to be compared with the reference voltage REF.

In more detail, the second comparison unit 402 may compare the voltage applied to the second input terminal IPN2 with the reference voltage REF. The second comparison unit 402 may output a second comparison signal COMSIG2 having a high or a low voltage through the second output terminal OPN2 by comparing the voltage applied to the second input terminal IPN2 with the reference voltage REF.

For example, the second input terminal IPN2 may be connected to another end of the second sensing resistor RS2. As the one end of the second sensing resistor RS2 is connected to the second ground terminal GN2 and the other end of the second sensing resistor RS2 is connected to the second input terminal IPN2, a second sensing voltage VS2 may be applied to the second input terminal IPN2.

The second comparison unit 402 may compare the second sensing voltage VS2 with the reference voltage REF, and may output the second comparison signal COMSIG2 through the second output terminal OPN2 corresponding to the comparison.

The first switching unit 501 may include a first input electrode IPP1, a first output electrode OPP1, a first pull-down electrode PDP1, and a first pull-up resistor PUR1.

For example, the first switching unit 501 may include a first transistor BT1 including the first input electrode IPP1, the first output electrode OPP1, and the first pull-down electrode PDP1.

The first input electrode IPP1 may be connected to the first output terminal OPN1.

The first output electrode OPP1 may be connected to the power control unit 202.

The first pull-down electrode PDP1 may receive a pull-down voltage. For example, the first pull-down electrode PDP1 may be grounded, and the pull-down voltage may be equal to about 0 V.

One end of the first pull-up resistor PUR1 may receive a pull-up voltage VL. Another end of the first pull-up resistor PUR1 may be connected to the first output electrode OPP1.

As described above, the first comparison unit 401 may output the high voltage or the low voltage through the first output terminal OPN1. The first switching unit 501 may be turned on or turned off by the high voltage or the low voltage.

For example, when the first sensing voltage VS1 is greater than the reference voltage REF, the first comparison signal COMSIG1 may have the high voltage. For example, the reference voltage REF may be equal to about 4 V, a voltage for turning on the first transistor BT1 may be equal to about 5 V, and the high voltage may be equal to about 5 V. In this case, the first switching unit 501 may be turned on.

When the first switching unit 501 is turned on, the first signal SIG1 may have the pull-down voltage.

In more detail, when the first switching unit 501 is turned on, the first switching unit 501 may output the pull-down voltage through the first output electrode OPP1.

On the other hand, when the first sensing voltage VS1 is less than the reference voltage REF, the first comparison signal COMSIG1 may have the low voltage. For example, the low voltage may be equal to about 0 V, and in this case, the first switching unit 501 may be turned off.

When the first switching unit 501 is turned off, the first signal SIG1 may have the pull-up voltage VL.

In more detail, when the first switching unit 501 is turned off, the first pull-down electrode PDP1 and the first output electrode OPP1 may be electrically blocked from each other. Then, the first switching unit 501 may output the pull-up voltage VL through the first output electrode OPP1 by using the first pull-up resistor PUR1 that is electrically connected to the power control unit 202.

The second switching unit 502 may include a second input electrode IPP2, a second output electrode OPP2, a second pull down electrode PDP2, and a second pull up resistor PUR2.

For example, the second switching unit 502 may include a second transistor BT2 including the second input electrode IPP2, the second output electrode OPP2, and the second pull down electrode PDP2.

The second input electrode IPP2 may be connected to the second output terminal OPN2.

The second output electrode OPP2 may be connected to the power control unit 202.

The second pull-down electrode PDP2 may receive a pull-down voltage. For example, the second pull-down electrode PDP2 may be grounded, and the pull-down voltage may be equal to about 0 V.

One end of the second pull-up resistor PUR2 may receive the pull-up voltage VL. Another end of the second pull-up resistor PUR2 may be connected to the second output electrode OPP2.

As described above, the second comparison unit 402 may output the high voltage or the low voltage through the second output terminal OPN2. The second switching unit 502 may be turned on or turned off by the high voltage or the low voltage.

For example, when the second sensing voltage VS2 is greater than the reference voltage REF, the second comparison signal COMSIG2 may have the high voltage. For example, the reference voltage REF may be equal to about 4 V, a voltage for turning on the second transistor BT2 may be equal to about 5 V, and the high voltage may be equal to about 5 V. In this case, the second switching unit 502 may be turned on.

When the second switching unit 502 is turned on, the second signal SIG2 may have the pull-down voltage.

In more detail, when the second switching unit 502 is turned on, the second switching unit 501 may output the pull-down voltage through the second output electrode OPP2.

On the other hand, when the second sensing voltage VS2 is less than the reference voltage REF, the second comparison signal COMSIG2 may have the low voltage. For example, the low voltage may be equal to about 0 V, and in this case, the second switching unit 502 may be turned off.

When the second switching unit 502 is turned off, the second signal SIG2 may have the pull-up voltage VL.

In more detail, when the second switching unit 502 is turned off, the second pull-down electrode PDP2 and the second output electrode OPP2 may be electrically blocked from each other. Then, the second switching unit 502 may output the pull-up voltage VL through the second output electrode OPP2 by using the second pull-up resistor PUR2 that is electrically connected to the power control unit 202.

In summary, when the first and second switching units 501 and 502 are turned on, each of the first and second signals SIG1 and SIG2 may have the pull-down voltage as an off signal, and when the first and second switching units 501 and 502 are turned off, each of the first and second signals SIG1 and SIG2 may have the pull-up voltage VL as an on signal.

The power control unit 202 may determine whether overcurrent flows in one of the first and second data driving chips DC1 and DC2 based on the first and second signals SIG1 and SIG2.

For example, when the first signal SIG1 has the pull-down voltage, and/or the second signal SIG2 has the pull-down voltage, the power control unit 202 may determine that overcurrent flows in the first data driving chip DC1 and/or the second data driving chip DC2. In this case, the power control unit 202 may block each of the first and second powers V1 and V2.

In the related art, a power applied to a data driving chip is blocked by adding a current flowing in each of a plurality of data driving chips, and determining whether the added current is overcurrent. However, even if a current flowing in one among a plurality of data driving chips is overcurrent, when a value obtained by adding a current flowing in each of the plurality of data driving chips is less than a reference value, a power control unit may not block power. According to one or more embodiments of the inventive concept, an overcurrent flowing in each of a plurality of data driving chips is measured by including a sensing resistor in each of the plurality of data driving chips to separately measure a current flowing in each sensing resistor. Furthermore, a comparison unit (e.g., a comparator) for measuring overcurrent and a switching unit (e.g., a switch) are mounted (e.g., directly mounted) on a data driving chip to improve convenience in processes and to reduce manufacturing costs.

Figure 4:
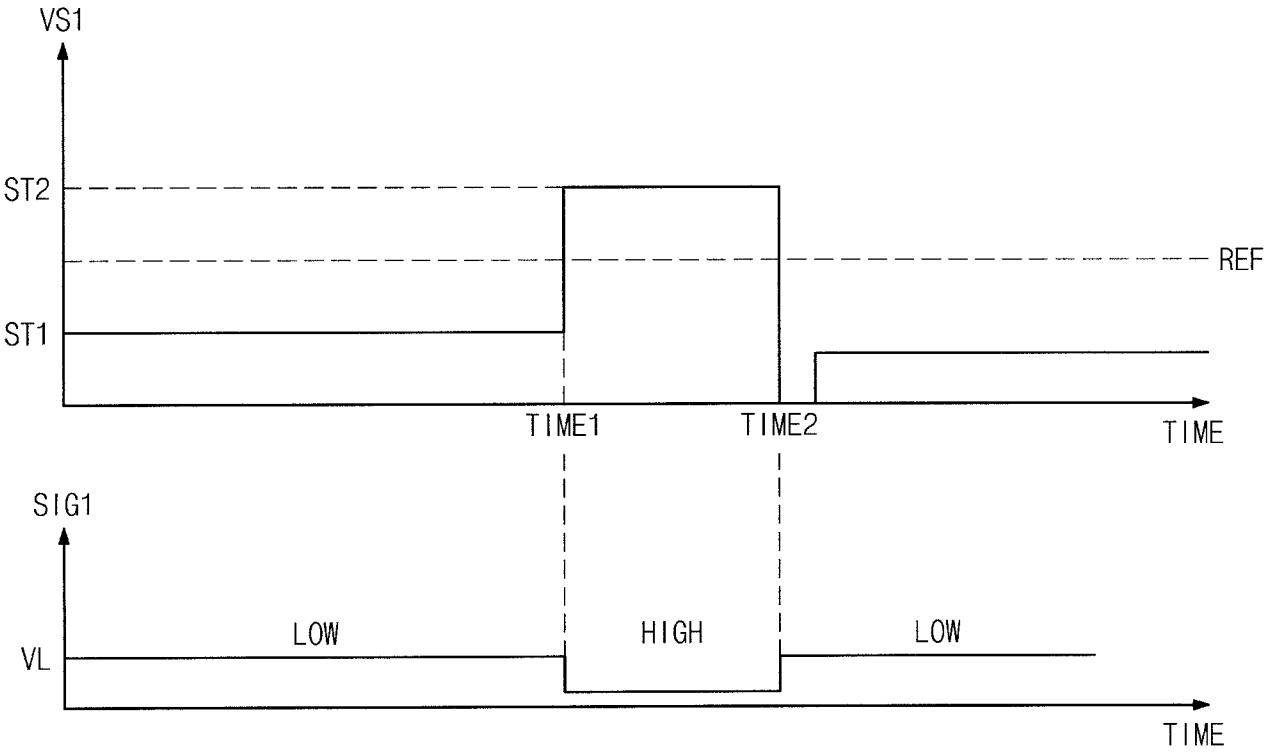
FIG. 4 is a graph illustrating a process of a power control unit according to an embodiment of the inventive concept.

FIG. 4 is a graph illustrating a process of the power control unit according to an embodiment of the inventive concept.

In FIG. 4, a case of a time when the power control unit 202 blocks the first power V1 or the second power V2 is shown.

With reference to FIG. 4, the following description is based on the first data driving chip DC1 from among the first and second data driving chips DC1 and DC2. However, it should be apparent that the following description may be applied to the second data driving chip DC2.

Referring to FIGS. 3 and 4, overcurrent does not flow in the first data driving chip DC1 before a first time TIME1, and overcurrent flows in the first data driving chip DC1 at the first time TIME1.

Before the first time TIME1, the first comparison unit 401 may output the first comparison signal COMSIG1 having the low voltage through the first output terminal OPN1. When the low voltage is outputted, the first switching unit 501 is turned off, so that the first signal SIG1 may have the pull-up voltage VL. Accordingly, the power control unit 202 receives the first signal SIG1 having the pull-up voltage VL, and determines that overcurrent does not flow in the plurality of driving chips DC. Thus, the power control unit 202 may supply (e.g., continuously supply) the first and second powers V1 and V2 to the first and second data driving chips DC1 and DC2.

When overcurrent flows in the first data driving circuit C1 of the first data driving chip DC1 as the first time TIME1 elapses, the first comparison unit 401 may output the high voltage through the first output terminal OPN1.

When the high voltage is outputted, the first switching unit 501 is turned on, so that the first signal SIG1 may have the pull-down voltage.

The power control unit 202 may receive the first signal SIG1 having the pull-down voltage, and may determine that overcurrent flows in the plurality of driving chips DC, as described above. Thus, the power control unit 202 may block the first power V1 and the second power V2.

When the first power V1 is blocked, overcurrent no longer flows in the first data driving circuit C1. For example, as shown in FIG. 4, the first power V1 may be blocked at a second time TIME2.

When the second time TIME2 elapses, as the first power V1 is blocked, the first comparison unit 401 may output the low voltage through the first output terminal OPN1 again. Then, as the low voltage is outputted, the first switching unit 501 is turned off, so that the first signal SIG1 may have the pull-up voltage VL again, and the first data driving chip DC1 may perform the data driver function again.

Figure 5:
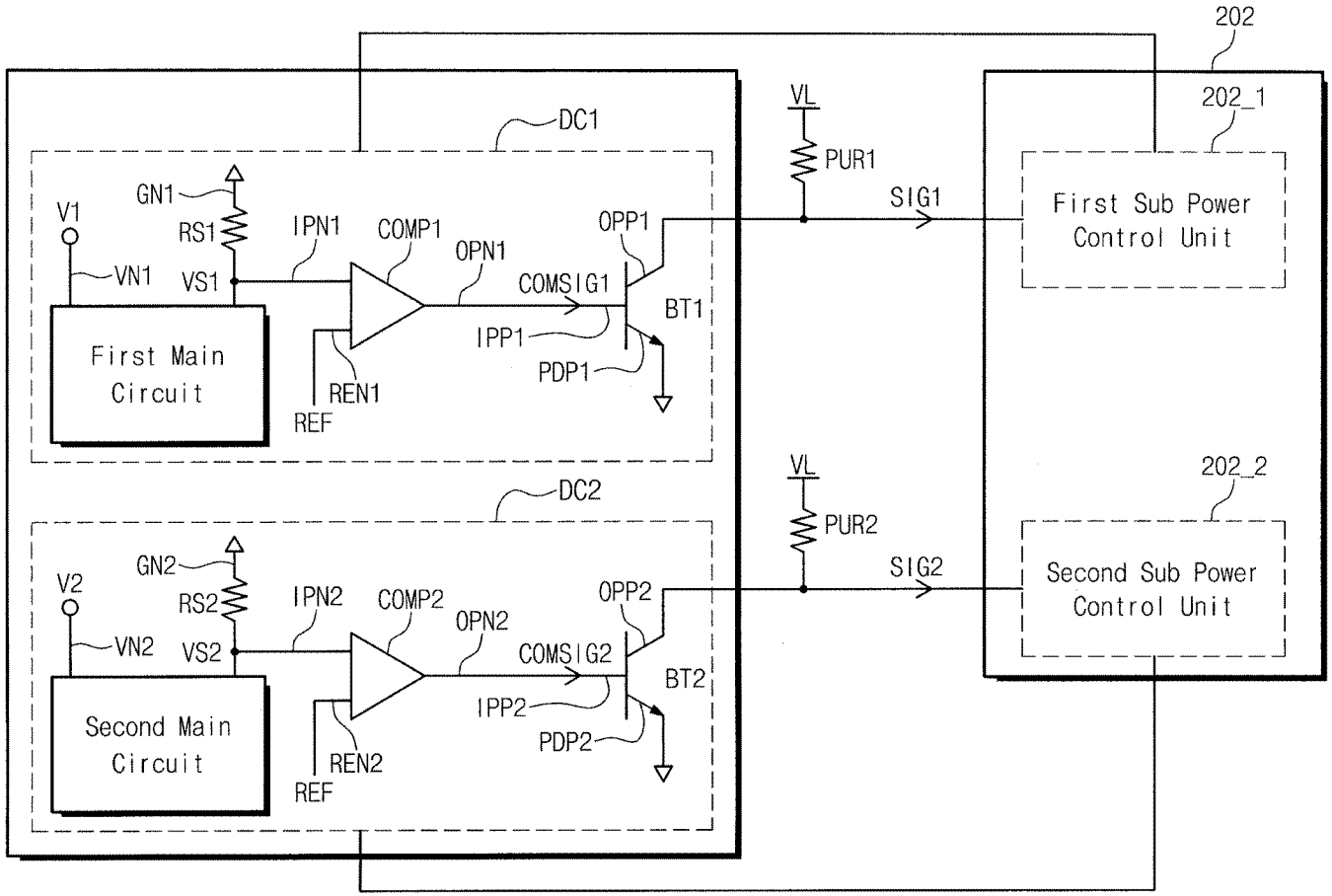
FIG. 5 is a view illustrating a power control unit shown in FIG. 2 according to another embodiment of the inventive concept.

FIG. 5 is a view illustrating the power control unit shown in FIG. 2 according to another embodiment of the inventive concept.

Referring to FIG. 5, the power control unit 202 may include a first sub power control unit (e.g., a first sub power controller) 202_1 and a second sub power control unit (e.g., a second sub power controller) 202_2.

The first sub power control unit 202_1 may determine whether overcurrent flows in the first data driving chip DC1 based on the first signal SIG1 described with reference to FIG. 3.

In more detail, the first sub power control unit 202_1 may block the first power V1 according to the first signal SIG1.

For example, when the first signal SIG1 is the pull-down voltage, the first sub power control unit 202_1 may block the first power V1 based on the pull-down voltage.

The second sub power control unit 202_2 may determine whether overcurrent flows in the second data driving chip DC2 based on the second signal SIG2 described with reference to FIG. 3.

In more detail, the second sub power control unit 202_2 may block the second power V2 according to the second signal SIG2.

For example, when the second signal SIG2 is the pull-down voltage, the second sub power control unit 202_2 may block the second power V2 based on the pull-down voltage.

As shown in FIG. 5, because the first sub power control unit 202_1 and the second sub power control unit 202_2 are respectively connected to the first and second data driving chips DC1 and DC2 and are separately controlled, a plurality of powers flowing in the plurality of data driving chips may be separately controlled.

Figure 6:
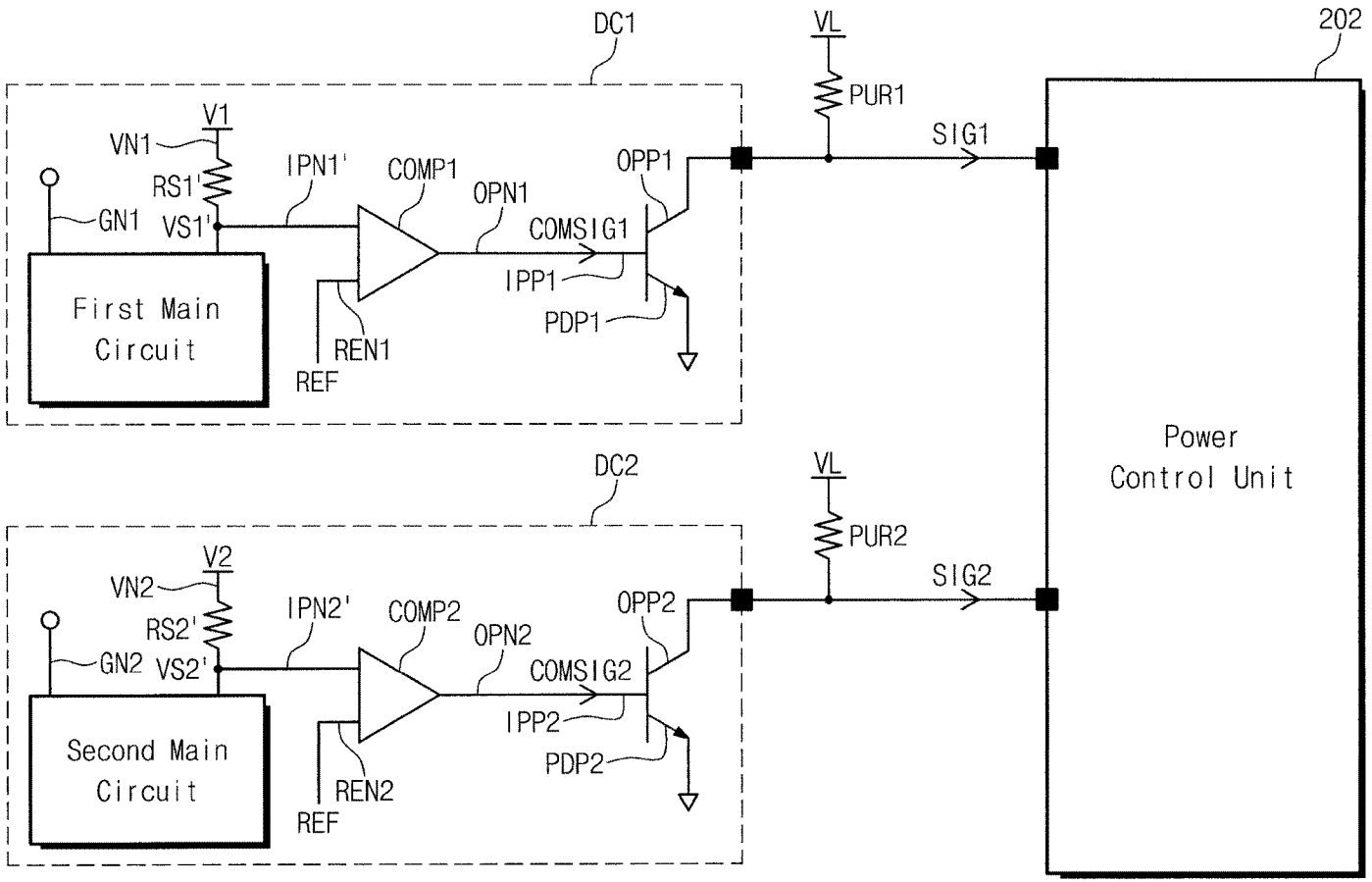
FIG. 6 is a is a schematic circuit of the first and second driving chips shown in FIG. 2 according to another embodiment of the inventive concept.

FIG. 6 is a schematic circuit of the first and second driving chips shown in FIG. 2 according to another embodiment of the inventive concept.

Referring to FIG. 6, unlike that of FIG. 3, one end of the first sensing resistor RS1' may be connected to the first power terminal VN1 of the first data driving circuit C1. The other end of the first sensing resistor RS1' is connected to the first input terminal IPN1', and thus, the first sensing voltage VS1' may be applied to the first input terminal IPN1'.

Similarly, one end of the second sensing resistor RS2' may be connected to the second power terminal VN2 of the second data driving circuit C2. The other end of the second sensing resistor RS2' is connected to the second input terminal IPN2', and thus, the second sensing voltage VS2' may be applied to the second input terminal IPN2'.

Because the remaining elements and components are the same or substantially the same as those of FIG. 3, their descriptions will not be repeated.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Although exemplary embodiments of the present invention have been described, it is understood that the present invention should not be limited to these exemplary embodiments, and that various changes and modifications may be made by one having ordinary skilled in the art within the spirit and scope of the present invention as defined in the following claims and their equivalents.

What is claimed is:

1. A display device comprising:

a first data driving chip comprising:

a first data driving circuit to generate a first data signal; and a first sensor to sense a first overcurrent flowing in the first data driving circuit based on a first power current flowing in the first data driving circuit to generate a first signal;

a second data driving chip comprising:

a second data driving circuit to generate a second data signal; and a second sensor to sense a second overcurrent flowing in the second data driving circuit based on a second power current flowing in the second data driving circuit to generate a second signal; and a power controller to control first and second powers respectively supplied to the first and second data driving chips, and to block at least one of the first and second powers based on at least one of the first and second signals, wherein the first data driving circuit comprises a first sensing resistor to transmit the first power current, one end of the first sensing resistor being connected to a first ground terminal of the first data driving circuit.

2. The display device of claim 1, wherein the first power current is a first current flowing in a first power port of the first data driving circuit;

the first power port is connected to the power controller and is configured to receive the first power;

the second power current is a second current flowing in a second power port of the second data driving circuit; and the second power port is connected to the power controller and is configured to receive the second power.

3. The display device of claim 1, wherein the second data driving circuit comprises a second sensing resistor to transmit the second power current, one end of the second sensing resistor being connected to a second ground terminal of the second data driving circuit.

4. The display device of claim 3, wherein the first sensor comprises a first comparator comprising a first input terminal connected to another end of the first sensing resistor to receive a first sensing voltage, a first reference terminal to receive a reference voltage, and a first output terminal to output a first comparison signal;

the second sensor comprises a second comparator comprising a second input terminal connected to another end of the second sensing resistor to receive a second sensing voltage, a second reference terminal to receive the reference voltage, and a second output terminal to output a second comparison signal;

the first comparison signal is generated based on the first sensing voltage and the reference voltage; and the second comparison signal is generated based on the second sensing voltage and the reference voltage.

5. The display device of claim 4, wherein the first sensor further comprises a first switch comprising a first input electrode connected to the first output terminal, a first output electrode connected to the power controller, and a first pull-down electrode to receive a pull-down voltage; and the second sensor further comprises a second switch comprising a second input electrode connected to the second output terminal, a second output electrode connected to the power controller, and a second pull-down electrode to receive the pull-down voltage.

6. The display device of claim 5, wherein the first switch further comprises a first pull-up resistor, one end of the first pull-up resistor to receive a pull-up voltage, and another end of the first pull-up resistor being connected to the first output electrode; and the second switch further comprises a second pull-up resistor, one end of the second pull-up resistor to receive the pull-up voltage, and another end of the second pull-up resistor being connected to the second output electrode.

7. The display device of claim 6, wherein the first and second comparison signals have a high voltage and the first and second switches are configured to be turned on, when the first and second sensing voltages are greater than the reference voltage; and the first and second comparison signals have a low voltage and the first and second switches are configured to be turned off, when the first and second sensing voltages are less than or equal to the reference voltage.

8. The display device of claim 7, wherein each of the first and second signals has the pull-down voltage, when the first and second switches are turned on; and each of the first and second signals has the pull-up voltage, when the first and second switches are turned off.

9. The display device of claim 1, wherein the power controller is configured to determine which one from among the first and second data driving chips an overcurrent flows based on the first and second signals, and to block each of the first and second powers.

10. The display device of claim 1, wherein the power controller comprises:

a first sub power controller connected to the first sensor, the first sub power controller to block the first power based on the first signal; and a second sub power controller connected to the second sensor, the second sub power controller to block the second power based on the second signal.

11. A display device driving method, the method comprising:

sensing a first overcurrent flowing in a first data driving circuit based on a first power current flowing in the first data driving circuit for generating a first data signal;

generating a first signal based on a result obtained by sensing the first overcurrent flowing in the first data driving circuit;

sensing a second overcurrent flowing in a second data driving circuit based on a second power current flowing in the second data driving circuit for generating a second data signal;

generating a second signal based on a result obtained by sensing the second overcurrent flowing in the second data driving circuit; and blocking at least one of a first power provided to the first data driving circuit and a second power provided to the second data driving circuit based on at least one of the first and second signals, wherein the first data driving circuit comprises a first sensing resistor to transmit the first power current, one end of the first sensing resistor being connected to a first ground terminal of the first data driving circuit.

12. The method of claim 11, wherein the generating of the first signal further comprises comparing a reference voltage and a first sensing voltage applied to the first sensing resistor where the first power current flows to generate a first comparison signal.

13. The method of claim 12, wherein the generating of the second signal comprises comparing the reference voltage and a second sensing voltage applied to a second sensing resistor where the second power current flows to generate a second comparison signal.

14. The method of claim 11, wherein the first power current flows in a first power port of the first data driving circuit, and the first power port is connected to a power controller, the power controller for supplying the first and second powers; and the second power current flows in a second power port of the second data driving circuit, and the second power port is connected to the power controller.

15. The method of claim 11, wherein the blocking of the at least one of the first and second powers comprises:

blocking the first power based on the first signal; and blocking the second power based on the second signal.

16. The method of claim 11, wherein the first data driving circuit supplies the first data signal to a display panel through a data line on the display panel; and the second data driving circuit supplies the second data signal to the display panel through the data line.

17. A display device driving method, the method comprising:

sensing a first overcurrent flowing in a first data driving circuit based on a first power current flowing in the first data driving circuit for generating a first data signal;

generating a first signal based on a result obtained by sensing the first overcurrent flowing in the first data driving circuit;

sensing a second overcurrent flowing in a second data driving circuit based on a second power current flowing in the second data driving circuit for generating a second data signal;

generating a second signal based on a result obtained by sensing the second overcurrent flowing in the second data driving circuit; and blocking at least one of a first power provided to the first data driving circuit and a second power provided to the second data driving circuit based on at least one of the first and second signals, wherein the generating of the first signal comprises comparing a reference voltage and a first sensing voltage applied to a first sensing resistor where the first power current flows to generate a first comparison signal, wherein the generating of the first signal further comprises generating a pull-up voltage or a pull-down voltage as the first signal in response to the first comparison signal.

18. The method of claim 17, wherein the generating of the first signal further comprises:

when the first comparison signal is a high voltage, generating the pull-down voltage as the first signal in response to the high voltage; and when the first comparison signal is a low voltage, generating the pull-up voltage as the first signal in response to the low voltage.

* * * * *